United States Patent [19]

Barbashin et al.

[11] 4,137,422

[45] Jan. 30, 1979

[54] AIRTIGHT METAL MELTING FURNACE

[76] Inventors: Oleg A. Barbashin, ulitsa Rodionova, 188, kv. 25; Alexandr A. Okunev, bulvar Jubileiny, 3, kv. 64, both of, Gorky; Sergei K. Mikhailov, Avtovskaya ulitsa, 2, kv. 116, Leningrad; Lev E. Mochalov, ulitsa L. Tolstogo, 74, Gorky; Lev P. Orlov, ulitsa Kultury, 16, kv. 7, Gorky; Lev B. Shenderov, ulitsa Kultury, 10, kv. 35, Gorky; Nikolai S. Shelepov, ulitsa Geroev Kosmosa, 2a, kv. 96, Gorky; Vissarion M. Dubodin, 2 Mokhovoi proezd, 24, kv. 7, Gorky; Alexandr S. Vladimirov, ulitsa Vasilisy Kozhinoi, 8, korpus 1, kv. 12, Moscow; Igor V. Gorynin, ulitsa Gromova, 16, kv. 50, Leningrad, all of U.S.S.R.

[21] Appl. No.: 788,790

[22] Filed: Apr. 19, 1977

[51] Int. Cl.[2] ..... F27D 21/00

[52] U.S. Cl. ..... 13/9 R; 13/1; 13/31 EB

[58] Field of Search ..... 13/1, 9, 10, 34, 33, 13/31; 266/99, 100

[56] References Cited

U.S. PATENT DOCUMENTS

| | | | |
|---|---|---|---|
| 3,612,739 | 10/1971 | Korneff | 13/9 |
| 3,760,960 | 9/1973 | Schumacher et al. | 13/33 X |

*Primary Examiner*—R. N. Envall, Jr.

*Attorney, Agent, or Firm*—Lackenbach, Lilling & Siegel

[57] ABSTRACT

An airtight metal melting furnace comprises a melting chamber enclosed by a lined metal shell and a refractory roof with a metal cover. An upper electrode and a hearth electrode are introduced into the melting chamber in order for a plasma or electric arc to be developed therein. Mounted above the roof cover is a slot table supporting means for measuring the temperature of the molten metal, means for drawing samples thereof, and means for introducing additives therein, the means being fixed in slots of said table. The cover and the furnace roof are formed with a channel which is shut by a gate. The slot table is mounted for plano-parallel movement, this permitting an alternate arrangement of said means above said channel and tight joining of the channel and the respective means.

12 Claims, 10 Drawing Figures

AIRTIGHT METAL MELTING FURNACE

FIELD OF THE INVENTION

The present invention relates to electrometallurgy and, more particularly, to airtight metal melting furnaces.

This invention is broadly applicable for adaptation in melting high-alloy steels and alloys in plasma arc furnaces.

DESCRIPTION OF THE PRIOR ART

Known in the art are airtight metal melting furnaces comprising a lined melting chamber enclosed by a metal shell and a refractory roof. The lining of the melting chamber and its enclosing shell are formed with a working port for deslagging and repair of the furnace slopes and with a port for tapping the metal. The melting chamber has introduced thereinto through a seal in the roof cover at least one upper electrode which can be made as a plasmatron. Lined in the hearth of the melting chamber is a hearth electrode.

Prior to the melting process, a prescribed working atmosphere is established in the furnace melting chamber. Next, an arc is produced between the upper electrode and the charge, the charge being in contact with the hearth electrode. This results in melting of the metal, which process is accompanied by the introduction of slag-forming and alloying elements into the melting chamber, measurement of the molten metal temperature and sampling thereof. While the aforesaid operations are being performed, there occurs a loss of sealing through the working port or a special channel provided in the furnace roof. The working atmosphere of the furnace is thereby adversely affected, which consequently impairs the quality of the metal being melted.

More adequate are furnaces in current use and equipped with devices for measuring temperature of the metal, drawing samples thereof and introducing additives thereinto. These furnaces allow for conducting measurements of the molten metal temperature, introducing slag-forming and alloying additions into the molten metal and drawing samples of the molten metal with no seal failure occuring in the furnace due to the provision of independent channels for each said device formed in the furnace roof. When not in operation, the aforesaid devices are cut off from the furnace working space by means of water-cooled shutters mounted on water-cooled flanges.

The quality of the metal produced in such furnaces is improved, and the melting waste of the alloying elements is reduced. The furnaces of this type, however, suffer from a number of disadvantages, viz., a plurality of channels provided in the refractory lining of the furnace roof with water-cooled flanges and shutters arranged thereabove. This impairs the durability and reflectivity of the furnace roof, and results in heat losses.

SUMMARY OF THE INVENTION

Accordingly, it is an object of the present invention to provide a metal melting furnace such that its melting chamber roof will be of a higher durability.

Another object of the invention is to enhance the reflective power of the furnace melting chamber roof.

Still another object of the invention is to reduce heat losses taking place at the water-cooled elements of the devices adapted for measuring the molten metal temperature, sampling said molten metal and introducing alloying elements thereinto.

Still another object of the invention is to provide an airtight metal melting furnace which will ensure high quality of the metal being produced therein.

These objects of the invention are accomplished by an airtight metal melting furnace comprising a melting chamber enclosed by a lined metal shell and a refractory roof with a metal cover. The chamber is provided with a working port, for deslagging and repair of the furnace slopes, made in the melting chamber lining. Also included is a port with a pouring lip for pouring metal from side chamber. At least one upper electrode is introduced into the melting chamber through a seal fitted in the roof cover and a hearth electrode is also included, said electrodes being intended for producing a plasma or electric arc within the melting chamber. Means for measuring the molten metal temperature, means for sampling of said molten metal and means for introducing additives into the chamber are, according to the invention, arranged above the roof cover and securely mounted on a slot table. The table is mounted for plano-parallel movement, thus providing for and alternate arrangement of the aforesaid temperature-measuring, additive-introducing and sample-taking means above a channel formed in the furnace roof and its cover. This channel is cut off by a gate and provided with a seal ensuring tight connection between the channel and one of the means being brought in contact therewith.

The provision of a table fitted with slots to accommodate the temperature-measuring, sample-taking and additive-introducing means and mounted for plano-parallel movement allowing alternate arrangement of said means above the channel formed in the furnace roof makes it possible to reduce the number of channels intended for carrying out the respective operations to only one channel. Hence a smaller number of water-cooled flanges and gates, which cut off the channels in the furnace roof, lower heat losses and higher reflective power and durability of the furnace roof are attained.

The slot table can be mounted for reciprocating movement relative to the roof channel, with slots being arranged in a straight line.

With the slot table being readily mounted for reciprocating movement relative to the roof channel, the aforesaid process means can be brought out of the furnace, which simplifies their operation and repair and also facilitates operation of the gate.

The aforesaid table is likewise readily mounted for rotatable movement relative to the roof channel, with the slots thereof being arranged along the circumference described from the center of the table's rotation.

Such a rotatable arrangement of the slot table makes it possible to utilize an incremental drive mechanisms of compact form with a prescribed pitch, this ensuring that said means is strictly brought in contact with and above the roof channel.

It is advantageous that the seal, providing for tight jointing of the channel with a movable means, be mounted on the gate for movement in the direction parallel to the channel axis.

The movable seal placed on the gate secures tight sealing of the melting chamber in the course of one of said process operations and ensures a constant working atmosphere in the melting furnace.

It is preferable that the rotatably mounted slot table be readily movable in the vertical plane, which makes possible intimate mating of the table surface with the channel seal, thereby tightly sealing said channel. This in turn simplifies the structure of the seal which provides for tight sealing of the roof channel, said seal remaining in fixed position.

It is preferable that the furnace, the slot table of which is mounted for rotating and vertical movement, be provided with a drive mechanism ensuring independent vertical and rotating movement of the table. The said drive mechanism comprises a hollow turnable column on which a bracket with a table to be driven along said column is mounted; a feed screw coaxially arranged in said column, interacting with a nut associated with said bracket; and and cooperating with said drive mechanism, as a means for braking said feed screw relative to the column. Such drive mechanism is fairly space-saving and reliable in operation.

It is recommended that the means for introducing additives be provided with a protective sleeve arranged coaxially with a supply pipe of the additive-introducing means, said sleeve being driven in a direction parallel to the axis of the supply pipe.

Such a constructional arrangement of the additive-introducing means in the herein proposed furnace prevents the gate from being clogged at the moment of introduction of additives and ensures the gate operating reliability, thus providing a tightly sealed channel disposed in the furnace roof. In case the furnace is provided with but one upper electrode, it will be advantageous to have this electrode arranged along the same line as said process means so that said electrode can be introduced into the melting chamber through said roof channel alternately with the process means. This makes it possible to further improve both the roof reflectivity and durability.

BRIEF DESCRIPTION OF THE DRAWINGS

The present invention will now be explained in greater detail with reference to embodiments thereof which are represented in the accompanying drawings, wherein.

DETAILED DESCRIPTION OF THE INVENTION

Figure 1:
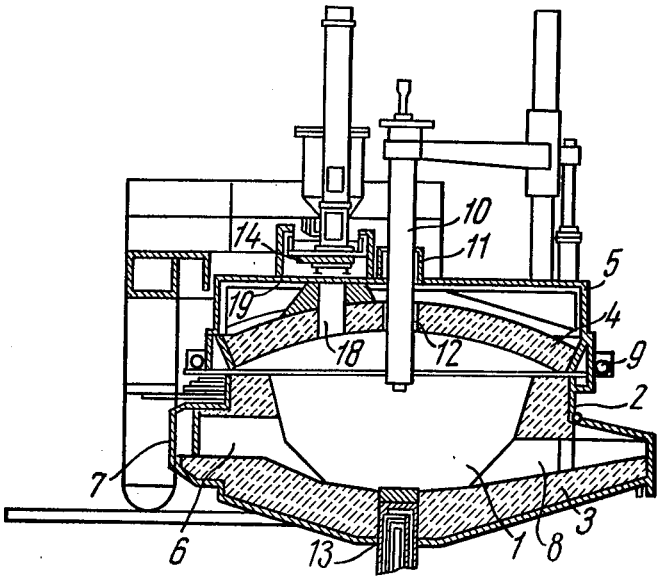
FIG. 1 is a sectional view of an airtight metal melting furnace provided with a roll-away roof and a table mounted for reciprocating movement, according to the invention.

Referring now to the drawings, an airtight metal melting furnace comprises a melting chamber 1 (FIG. 1) enclosed by a metal shell 2 provided with a refractory lining 3 and by a refractory roll-away roof 4 with a metal cover 5. The melting chamber 1 has a working port 6 for deslagging and repair of the furnace slopes, which is tightly closed by a door 7, and a port 8 with a lip formation for pouring the metal from the melting chamber 1. The roof 4 is tightly jointed with the metal shell 2 of the melting chamber 1 with a seal 9. The melting chamber 1 is provided with an upper electrode 10 introduced thereinto through a seal 11 and a channel 12 in the roof 4, and with a hearth electrode 13 introduced into said melting chamber 1 with one end thereof having a steel build-up and connected to positive terminal of a power source.

Securely mounted above the cover 5 of the roof 4 is a slot table 14 (FIG. 1, 2) supporting, fixed in its slots, a means 15 (FIG. 2) for introducing additives, a means 16 for drawing samples and a means 17 for measuring temperature. Formed in the roof 4 (FIG. 1) and in the cover 5 is a channel 18 which is tightly cut off by a gate 19.

The slot table is mounted for plano-parallel movement, thus permitting and alternate arrangement of said means over the channel disposed in the furnace roof and its cover.

Thus, the slot table 14 is mounted for reciprocating movement relative to the channel 18 disposed in the roof 4. The slots of said table 14 are adapted to receive the means 15, 16 and 17 (FIG. 2) which are arranged along the same straight line. The table 14 is mounted on guides 20 and connected by means of a feed screw 21 with an electric actuator 22 which is operable to provide the table 14 with reciprocating movement, thus permitting coaxial arrangement of one of the means 15, 16 and 17 with the channel 18 (FIG. 1).

Figure 2:
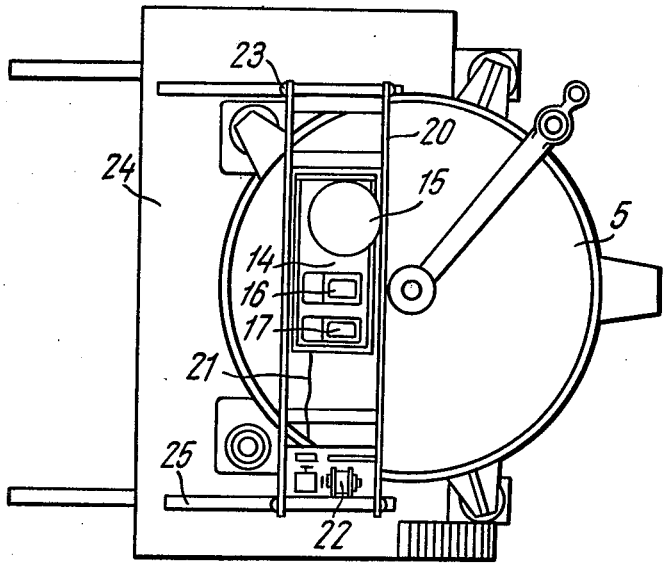
FIG. 2 is a top view of the device shown in FIG.1.

The guides 20 (FIG. 2) rest upon supporting members 23 which are placed outside the furnace and bear up against a carriage 24 intended for rolling away the roof 4 (FIG. 1). The carriage 24 (FIG. 2) is formed with guides 25 intended for the support members 23, thus making it possible for the guides 20 to be driven perpendicular to the movement of the table 14. This mutual perpendicular movement facilitates axial alignment of one of the means 15, 16, 17 with the channel 18 (FIG. 1).

Figure 3:
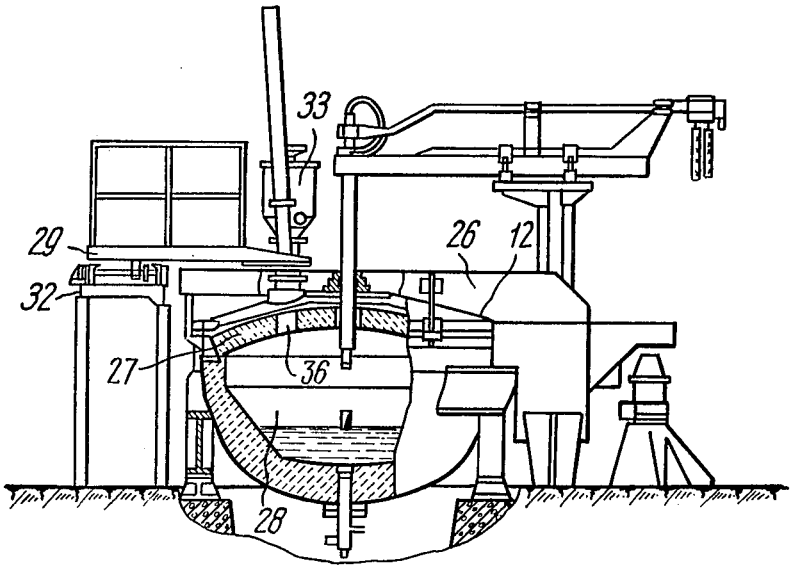
FIG. 3 is a sectional view of a furnace provided with a turnable roof and a table mounted for reciprocating movement, according to the invention.
Figure 4:
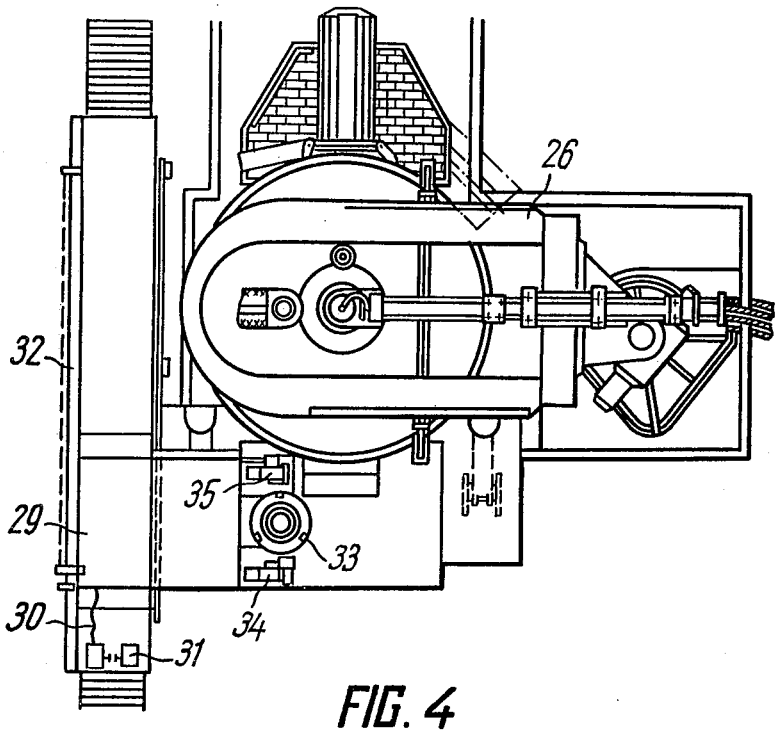
FIG. 4 is a top view of the device shown in FIG. 3.

Still another embodiment of a table mounted for reciprocating movement is shown in FIGS. 3 and 4. In this case the furnace is provided with a turnably mounted portal 26 adapted to support a roof 27 (FIG. 3) of the furnace which comprises a melting chamber 28. A table 29 travels by means of a feed screw 30 (FIG. 4) and with the aid of an electric actuator 31 along guides 32, thus providing reciprocating movement of process means 33, 34 and 35 for introducing additives, drawing samples and measuring temperature, respectively. These means are arranged in fixed positions in the slots of the table 29 along a straight line. The reciprocating movement of the table 29 makes possible axial arrangement of one of the aforesaid means with a channel 36 (FIG. 3) formed in the furnace roof 27 and its cover.

The slot table 37 carrying said process means is readily mounted for rotating movement relative to the channel 36 formed in the furnace roof and its cover, (FIG. 5, 6), mounted is above the roof 27 (FIG. 5) and is supported by the turnably mounted portal 26. The table 37 is rotatable by means of an air actuator 38 around an axle 39 fixed on the portal 26 and is brought away together with the roof 27 by means of the portal 26 at the time when the furnace is being charged. A means 40 (FIG. 6) for introducing additives, a means 41 for drawing samples and a means 42 for measuring temperature are each fixed in the slots of the table 37 and arranged along the circumference described from the center of the table's rotation. These means can each be readily brought in alignment with and above the channel 36 (FIG. 5) when the table 37 is rotated to the appropriate position.

Figure 7:
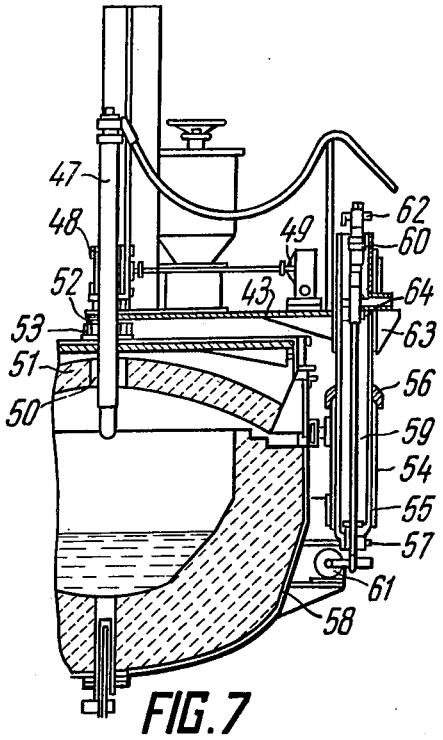
FIG. 7 is a sectional view of a furnace with a sector-shaped table mounted for vertical and rotating movement, according to the invention.
Figure 8:
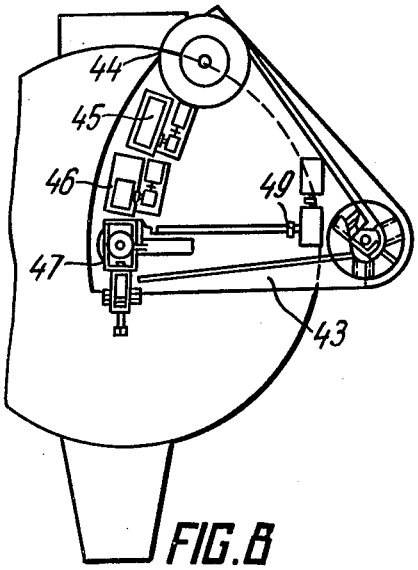
FIG. 8 is a top view of the device shown in FIG. 7.

A table 43 supporting these process means and adapted for rotation may have a sector shape as shown in FIGS. 7 and 8.

The table 43 has, fixed in its slots and arranged along the circumference described from the center of the table's rotation, a means 44 (FIG. 8) for introducing additives, a means 45 for drawing samples and a means 46 for measuring temperature. Arranged on the same table 43 along the same line with said process means is an upper electrode 47 with a roller stand 48 (FIG. 7) and a drive mechanism 49. By turning the table 43 it is possible to alternately arrange any of the means 44, 45, 46 or the electrode 47 above and in alignment with a channel 50 disposed in the furnace roof 51 and its cover.

To ensure intimate mating of the surface of the table 43 with a seal 52 of the channel 50 formed in the upper flange of a gate 53 cutting off the channel 50, the table 43 is adapted for movement in a vertical plane. A drive mechanism providing for independent vertical and rotating movements of the table 43 comprises a body 54 in which a hollow column 55 is turnably mounted for rotation about its axis and rests upon the body 54 through a thrust ball bearing 56. The lower cylindrical portion of the column 55 extends beyond the body 54 and is clasped by brake shoes of a lower brake member 57 of the column 55, said brake member being in connection with the shell 58 enclosing the furnace. Arranged within the column 55 and coaxially therewith is a feed screw 59 adapted for rotation relative to the column 55. The upper portion of the feed screw 59 bears up against the column 55 through a thrust ball bearing 60. The lower portion of the feed screw 59 extends beyond the lower end of the column 55 and is connected with a drive mechanism 61 mounted on the furnace shell 58. The upper portion of the feed screw 59 extends beyond the upper portion of the column 55 and is clasped by brake shoes of an upper brake 62 of the feed screw 59 rigidly fixed on the column 55. The upper portion of the column 55 is embraced by a bracket 63 movable in a vertical plane. The bracket 63 is connected through elongated port openings in the column 55 with a nut 64 fitted on the feed screw 59. The lifting and rotation of the table 43 is effected through the following operable units: the lifting is carried out by means of the feed screw 59 and rotation is actuated by means of the column 55 through the aforesaid feed screw 59. The lifting and rotating operations are effected independent of each other. The two brakes 57 and 62 are interlocked to be operated alternately, viz., when one is "on" the other is "off".

Figure 9:
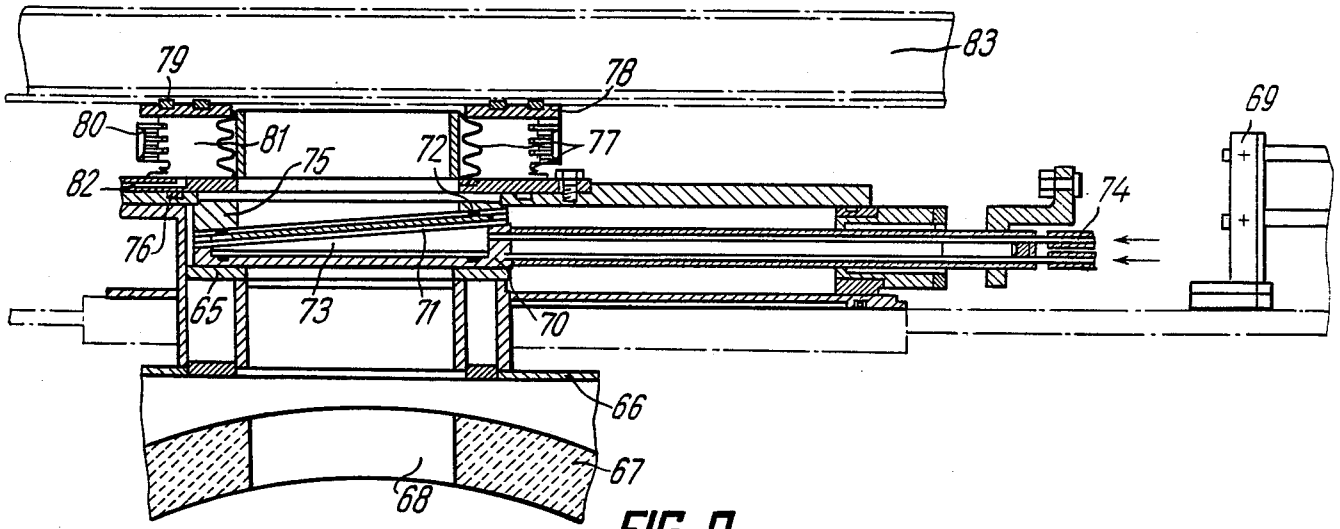
FIG. 9 is a sectional view of a furnace gate, according to the invention.

Tight jointing of the movable process means mounted on an immovable table with the channel disposed in the roof of the furnace is achieved by means of the gate shown in FIG. 9. This appliance has a body 65 tightly connected with a cover 66 of the furnace roof 67, the gate bore axis being aligned with the axis of a channel 68 disposed in the roof 67 and its cover 66.

Figure 10:
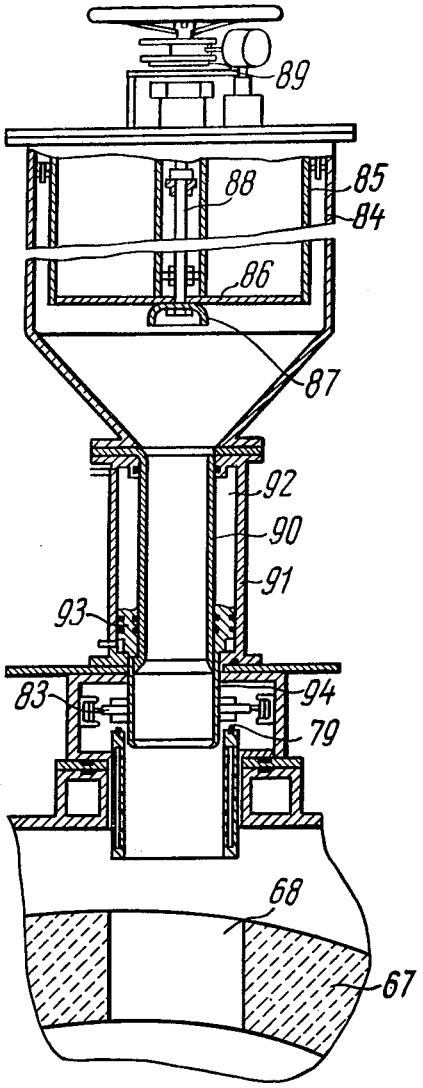
FIG. 10 is a longitudinal sectional view of a means for introducing additives, according to the invention.

The opening of the gate is shut with the aid of an air actuator 69 by a water-cooled shutter 70 having a membrane 71 with built-in seals 72. With the air being passed into a space 73 of the shutter 70 through a channel 74 of the membrane 71, the seal 72 adjoins the upper flange of the shutter 70. The upper flange 75 of the shutter 70 is provided with built-in seals 76 and has concentrically mounted thereupon two bellows 77 connected from above through a flange 78 with built-in seals 79. The bellows 77 are compressed by means of springs 80. A space 81, formed between the bellows 77, communicates through a channel 82 with an air system (not shown), whereby the seal 79 is pressed against a table 83 on which the means are arranged. To ensure reliable operation of the gate, it is necessary to prevent its seal 72 from being clogged with additive materials, which is provided for by the additive-introducing means shown in FIG. 10. The means for introducing additives comprises a tightly sealed casing 84 which accomodates therein a multisectional basket 85 formed with drop-bottom members 86 tightened by means of a washer 87 fitted on a shaft 88 connected with an electric actuator 89. The lower portion of the casing 84 has a cylinder-shaped supply pipe 90 which is enveloped from outside with a cylinder 91, thus defining a space 92 between them. Mounted within the space 92 is a piston ring 93 pneumatically or hydraulically driven along the supply pipe 90. The piston ring 93 passes at its lower portion into a protective sleeve 94 coaxially arranged with the supply sleeve 90, said sleeve closing the seals 79 when moving downwardly at the time of the additive-introducing operation.

The furnace of the herein proposed invention operates as follows.

After feeding a charge into the melting chamber 1 (FIG. 1), the roof 4 is brought over the furnace encasing shell 2 by means of the carriage 24 and is then lowered onto the seal 9, thus tightly sealing the melting chamber 1. Next the electrode 10 is introduced into the melting chamber 1 through the seal 11 positioned on a cover 5 of the roof 4, whereupon the melting chamber 1 is blown with the working gas for a five to seven minute period. Thereafter the electrode 10 and the hearth electrode 13 are energized and the melting process commences.

Towards the end of the melting period, the slot table 14 is moved by means of the electric actuator 22 in order to align the axis of the channel 18, shut by the gate 19, with the axis of the means 17 (FIG. 2) for measuring temperature. Then the gate 19 (FIG. 1) is opened and a temperature transducer is introduced into the melt. After taking the temperature and withdrawing the transducer from the melting chamber 1, the gate 19 is shut. The table 14 is moved to the position for drawing metal samples. When the additives are to be added, the table is moved to the appropriate position.

The furnace shown in FIG. 3 is provided with a roof 27 which slides over in order to shut the melting chamber 28 by means of a portal 26, which is widely used in arc furnaces. The melting process and process operations are carried out similarly to those described above. A table 29 travels along guides 32. To service the process means, and to allow metal tapping and slag runoff, the table 29 is brought outside the furnace.

Figure 5:
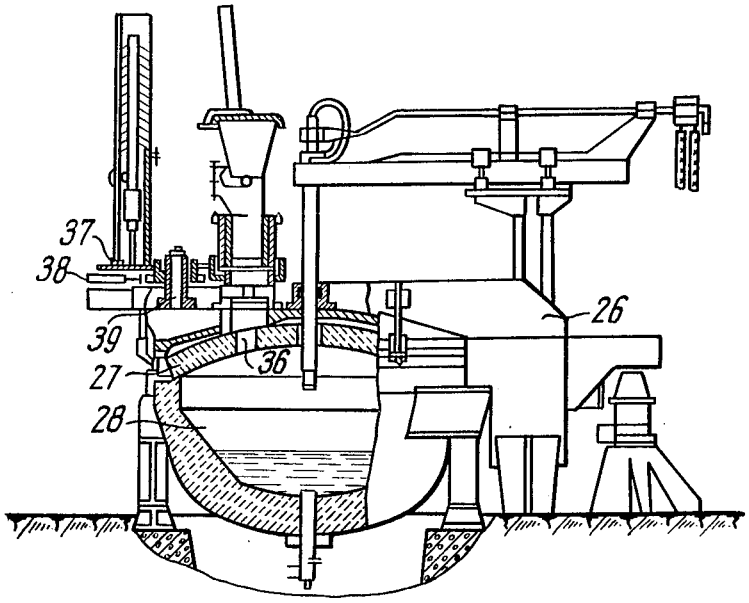
FIG. 5 is a sectional view of a furnace with a rotatably mounted table, according to the invention.
Figure 6:
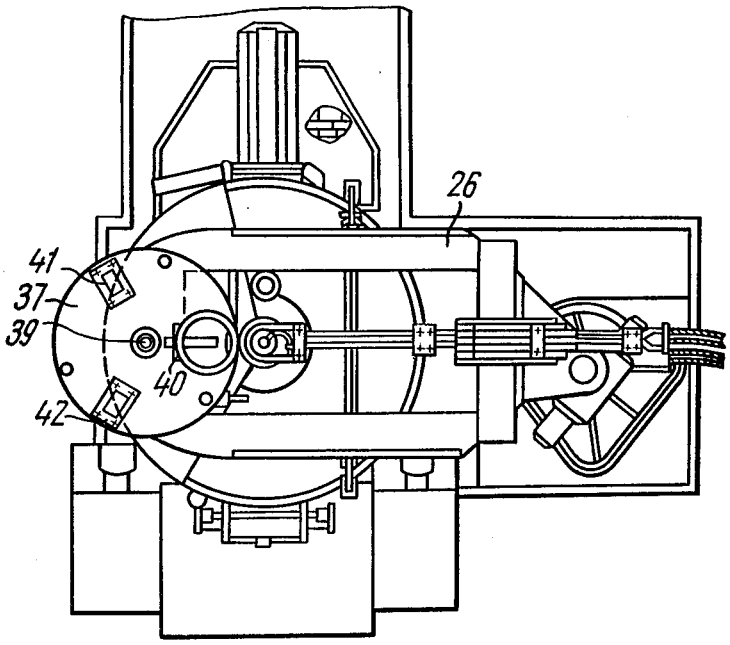
FIG. 6 is a top view of the device shown in FIG. 5.

The furnace shown in FIG. 5 has its roof 27 mounted over the melting chamber 28 by turning the portal 26, while one of the process means is arranged above the channel 36 of the roof 27. The process means are alternately changed as the table 37 is turned with aid of an air actuator 38.

The furnace shown in FIG. 7 operates as follows. Prior to starting the melting process, the table 43 is positioned beyond the zone of the roof 51 and is lowered down to avoid overheating of the process means. Said roof 51 is brought down to the furnace 58 by one of the above-described devices. The movement of the turnable column 55 is arrested by the brake 57. The drive mechanism 61 is actuated to impart rotation to the feed screw 59, thus forcing up the nut 64 connected through elongated port openings in the hollow column 55 with the bracket 63 on which the table 43 is mounted. From this it follows that the table 43 is lifted at a speed equal to that of the nut 64 moving upwardly along the feed screw 59. When the table 43 reaches its uppermost position, the brake 57 is released and the brake 62 is engaged to connect the turnable column 55 with the feed screw 59. As this happens, the column 55 rotates about its axis simultaneously with rotation of the feed screw 59 until there is axial alignment of the electrode 47 with a channel 50 in the roof 51.

The brake 62 is released and the brake 57 is engaged to arrest the movement of the hollow column 55. When the drive mechanism 61 is switched for reverse movement, the feed screw 59 is reversed and the nut 64 together with the bracket 63 and the table 43 are lowered. The table 43 is set on a seal 52 arranged in the upper flange of the gate 53. Thus the channel 50 is made airtight. The electrode 47 is introduced into the furnace melting chamber with the aid of the roller stand 48 driven by a drive mechanism 49, whereupon the melting process commences. When there is a necessity to carry out one of the process operations, the melting process is terminated, the electrode 47 is withdrawn from the furnace by means of the roller stand 48, and the table 43, driven by the drive mechanism 61, is uplifted with the column 55 being braked. Then, by releasing the brake from the column 55 the table 43 is turned until there is alignment of the given process means with the channel 50 in the furnace roof 51. In between the process operations the channel in the furnace roof is kept airtight by means of the gate 53.

To ensure tight jointing of the process means with channels formed in the furnace roofs, as shown in FIGS. from 1 to 6, when the furnace tables being are not movable in the vertical plane, a gate of the type shown in FIG. 9 is used. Before the melting process, the shutter 70 of the gate is driven by the air actuator 69 to shut the gate admission section. Air is delivered into the space 73 and, as this happens, the membrane 71 presses the seal 72 against the upper flange 75 of the shutter 70, thus sealing the channel 68 and making the melting chamber airtight. As a technological means is set above the channel 68 formed in the roof 67 and above the gate passageway extending into the space 81 formed between the bellows 77, a flow of air is passed along the channel 82. The bellows 77 expand to overcome the resistance of the springs 80. The seal 79 is pressed against the table 83 thereby sealing the channel 68 and making the furnace airtight when the shutter 70 is open. Air is released from the interior 73 and the membrane 71 with the seals 72 being drawn off from the gate upper flange 75. The shutter 70 is driven out by the air actuator 69 thereby opening the gate passageway. The furnace is ready for a process operation.

When the additive-introducing operation is conducted, the piston ring 93 (FIG. 10) of the protective sleeve 94 is either pneumatically or hydraulically driven downwards, overlapping the gate seal 79. Next the electric actuator 89 is energized to impart rotation to the washer 87 through the shaft 88. As the washer 87 rotates, the bottom members 86 formed in the sections of the charge basket 85 are successively opened. Additives are introduced into the melting chamber through the supply pipe 90, a protective sleeve 94 and the channel 68 formed in the furnace roof 67. After the additives have been introduced, the piston 93 of the protective sleeve 94 is pneumatically or hydraulically driven upwards, thereby opening the gate admissive section and making it possible for the gate to close.

With the additives introduced and the gate closed, the final stage of the melting process is then performed.

What is claimed is:

1. An airtight metal melting furnace, comprising a lined metal encasing shell; a refractory roof arranged above said shell, defining therewith a melting chamber and having a metal cover, said lined metal encasing shell being provided with a working port for deslagging and repair of the furnace slopes and with a discharge port for pouring metal from the melting chamber, a channel being formed in said roof and said cover; at least one upper electrode introduced into said melting chamber through an opening in the roof and the cover; a hearth electrode with said upper electrode producing a plasma or electric arc; a gate cutting off said channel; a table mounted above said roof cover for plane-parallel movement and fitted with slots; process means operable for measuring temperature of molten metal, for drawing samples of said molten metal and for introducing additives into said molten metal, fixed in said slots of said table and arranged alternately above said channel on said table; a seal providing tight joining of said channel with the process means being brought in alignment with said channel.

2. An airtight metal melting furnace, comprising a lined metal encasing shell; a refractory roof arranged above said shell, defining therewith a melting chamber and having a metal cover, said lined metal shell being provided with a working port for deslagging and repair of the furnace slopes and with a discharge port for pouring metal from said melting chamber, a channel being formed in said roof and said cover; at least one upper electrode introduced into said melting chamber; a hearth electrode with said upper electrode producing a plasma or electric arc; a gate cutting off said channel; a table mounted above said roof cover for reciprocating movement relative to said channel and fitted with slots arranged in a straight line running through the center of said channel, so that said table slots can be alternately brought in alignment with and above said channel; process means operable for measuring temperature of molten metal, for drawing samples of said molten metal and for introducing additives into said molten metal and fixed in said table slots; a seal providing for tight joining of said channel with the means being brought in alignment with said channel.

3. An airtight furnace as claimed in claim 2, wherein said channel seal is positioned on a gate and is movable in a direction coaxial with the channel.

4. An airtight furnace as claimed in claim 3, wherein said means for introducing additives comprises: a supply pipe; a protective sleeve arranged coaxially with said supply pipe; and an actuator urging said protective sleeve in a direction parallel to the axis of said supply pipe.

5. An air tight furnace as claimed in claim 2, wherein said upper electrode is affixed on said table along the same line with said process means so that its introduction into said melting chamber is effected through said channel alternately with said process means.

6. An airtight metal melting furnace, comprising: a lined metal encasing shell; a refractory roof arranged above said shell, defining therewith a melting chamber and having a metal cover, said lined encasing metal shell being provided with a working port for deslagging and repair of the furnace slopes and a discharge port for pouring the metal from said meting chamber, a channel being formed in said roof and said cover; at least one upper electrode introduced into said melting chamber; a hearth electrode with said upper electrode producing a plasma or electric arc within said melting chamber; a gate cutting off said channel; a table mounted above said roof cover for rotating movement relative to said channel and fitted with slots arranged along the circumference described from the center of rotation of said table and running through the center of said channel so that said table slots can be alternately brought in alignment with and above said channel; process means operable for measuring temperature of the molten metal, for drawing samples from said molten metal and for introducing additives into said molten metal and fixed in said table slots; a seal providing for tight joining of said channel with the means being brought in alignment with and above said channel.

7. An airtight furnace as claimed in claim 6, wherein said seal is positioned on a gate and is movable in a direction coaxial with the channel.

8. An airtight furnace as claimed in claim 7, wherein said means for introducing additives comprises: a supply pipe; a protective sleeve arranged coaxially with said supply pipe; and an actuator urging said sleeve in a direction parallel to the axis of said supply pipe.

9. An airtight furnace as claimed in claim 6, wherein said upper electrode is affixed on said table along the same line with said process means so that its introduction into said melting chamber is effected through said channel alternately with said process means.

10. An airtight furnace as claimed in claim 6, wherein said table is mounted for movement in the vertical plane for intimate mating of the surface table with said seal of the channel and for tight sealing of the channel and the table.

11. An airtight furnace as claimed in claim 10, further comprising: a drive mechanism translating vertical and rotating movement to said table; a hollow turnable column of said mechanism; a bracket rigidly connected with said table and movably mounted on and along said column; a feed screw of said mechanism mounted in and coaxially with said column; a nut associating with said feed screw and connected with said bracket; an actuator of said feed screw; a rotation brake of said column; and a break of said feed screw for arresting movement relative to said column.

12. An airtight furnace as claimed in claim 11, wherein said upper electrode is affixed on said table along the same line with said process means, so that said electrode can be introduced into said melting chamber through said channel alternately with said process means.

* * * * *